US006975301B2

(12) United States Patent
Fan

(10) Patent No.: US 6,975,301 B2
(45) **Date of Patent: *Dec. 13, 2005**

(54) REMOTE CONTROL FOR INTERACTIVE TELEVISION

(76) Inventor: Nongqiang Fan, P.O. Box 280763, San Francisco, CA (US) 94128-0763

( * ) Notice: Subject to any disclaimer, the term of this patent is extended or adjusted under 35 U.S.C. 154(b) by 307 days.

This patent is subject to a terminal disclaimer.

(21) Appl. No.: 10/295,416

(22) Filed: Nov. 16, 2002

(65) Prior Publication Data

US 2003/0071928 A1 Apr. 17, 2003

Related U.S. Application Data

(63) Continuation of application No. 09/280,015, filed on Mar. 28, 1999, now Pat. No. 6,535,198.

(51) Int. Cl.[7] ..... G09G 5/08
(52) U.S. Cl. ..... 345/158; 348/734
(58) Field of Search ..... 345/156–158; 348/734; 250/200

(56) References Cited

U.S. PATENT DOCUMENTS

| | | | |
|---|---|---|---|
| 4,591,841 | A | 5/1986 | Gunderson |
| 4,959,721 | A | 9/1990 | Micic |
| 5,767,919 | A | 6/1998 | Lee |
| 5,793,361 | A | 8/1998 | Kahn |

*Primary Examiner*—Kent Chang

(57) ABSTRACT

An improved remote control for interactive televisions is disclosed. The conventional remote control is improved by adding a light-scope as a remote-pointing device for defining an aiming point on the television screen. The light-scope consists of a photo detector and a lens system that defines a very narrow filed of view. An LED, driven by an electric signal converted from the light signal entering the light-scope, is used to create a communicating light signal. The communicating light signal, which is to some extent a replica of the light emitted from the aiming point, is sent back to the television for determine the aiming point.

16 Claims, 4 Drawing Sheets

REMOTE CONTROL FOR INTERACTIVE TELEVISION

CROSS REFERENCE OF RELATED INVENTION

This application is a continuation of application Ser. No. 09/280,015 filed Mar. 28, 1999 now U.S. Pat. No. 6,535,196.

FIELD OF THE INVENTION

This invention is related to television remote controls, and especially to remote controls that can remotely control the cursor position on the screen of a television.

BACKGROUND OF THE INVENTION

As pointed out by Thomas E. Weber in an article published on *Wall Street Journal* (p. R10, Mar. 21, 1994), one of the major problems with the current remote control for televisions is that there are too many buttons on these remote controls. These remote controls are becoming more and more complicated, and less and less user-friendly. In this disclosure, I describe a hybrid remote that has fewer buttons and has cursor control capability implemented to make the remote more versatile and more user friendly. Only those frequently used buttons are implemented on the remote. And all the other buttons are replaced with one or more "mouse" buttons in combination with cursor control capability. Those frequently used buttons are used to perform the basic functions such as volume up and down, channel up and down, and mute. The "mouse" button is used to perform all the rest not so frequently used functions. Which particular function the "mouse" button performs depend on where the cursor appears on the television screen. The method of how to implement the cursor control capability for the above described hybrid remote is the subject of the current invention.

If any of these televisions need to be used as Internet terminals, the cursor control capability on the remote will become a necessary requirement. And in fact, for interactive televisions, the cursor control capability on the remote will become an absolutely necessary requirement.

At present, there have been several methods of adding cursor control capabilities to a remote. To add cursor control capabilities, some remotes use track balls, some use joysticks, some use touchpads, some use "air mouse" (e.g. Sony's Egg and Creative Labs' AeroMouse or AeroPen), and still some others use cursor keys. All the above mentioned methods can be used to make a hybrid remote that can control the cursor on a television screen. However, all these remotes have one common disadvantage: the cursor position can not be controlled intuitively, comfortably or conveniently by the standard of average home users. It is therefore imperative to invent a remote control that enables a user to control the cursor on a television screen more easily and more intuitively.

One of the most intuitive ways for a user to control the cursor position is to add a remote-pointing device to a remote control, and position the cursor at the aiming point on the television screen pointed by the remote-pointing device. With a remote-pointing device added to the remote control, the cursor appears conveniently at where the remote control pointed.

In order to place the cursor at the aiming point on a television screen, the television need to be able to determine the position of that aiming point. While there are many methods for implementing the remote-pointing device and many methods for finding the aiming point, it is rather challenge to do it very cheaply—preferably at a fraction of the cost of making the commonly used IR remotes.

In this document, I disclose a method for making an improved remote control for interactive televisions by adding a remote-pointing device to a conventional remote control. The remote-pointing device is chosen to be a light-scope, which consists of a lens system that define a very narrow filed of view and a photo detector. The light signal, detected by the photo detector, is converted into an electric signal. After amplification, the electric signal is used to drive an LED for sending a communicating light signal back to the television. The television uses the communicating light signal to determine the aiming point.

SUMMARY OF THE INVENTION

It is an object of the invention to improve the remote control for televisions by adding a remote-pointing device to the remote control. This improvement enables a user to control the cursor position more easily than using the cursor keys found on conventional remote controls. The user only needs to point at where he or she wants the cursor to be, and instantaneously the cursor is there.

It is a further object of the invention to make this improve remote control with remote-pointing device non-obtrusive and cost effective.

Additional advantages and novel features of the invention will be set forth in the description which follows, and in part will become apparent to those skilled in the art upon examination of the following, or may be learned by practice of the invention. The objects and advantages of the invention maybe realized and attained by means of the instrumentality and combinations particularly pointed out in the appended claims.

To achieve the foregoing and other objects and in accordance with the present invention, as described and broadly claimed herein, a remote-pointing device is added to a remote control. A light-scope, consisting of a lens system that defines a very narrow filed of view and a photo detector, is provided to use as the remote-pointing device. An LED, driven by the amplified electric signal that is converted from the light signal detected by the photo detector, is provided for sending back to the television a communicating light signal. The communicating light signal is used by the television to determine the aiming point and display the cursor at that aiming point.

BRIEF DESCRIPTION OF THE DRAWINGS

The accompany drawings, which are incorporated in and form a part of the invention and, together with the description, serve to explain the principles of the invention. In the drawings, closely related figures have the same number but different alphabetic suffixes.

DESCRIPTION OF THE INVENTION

Figure 1:
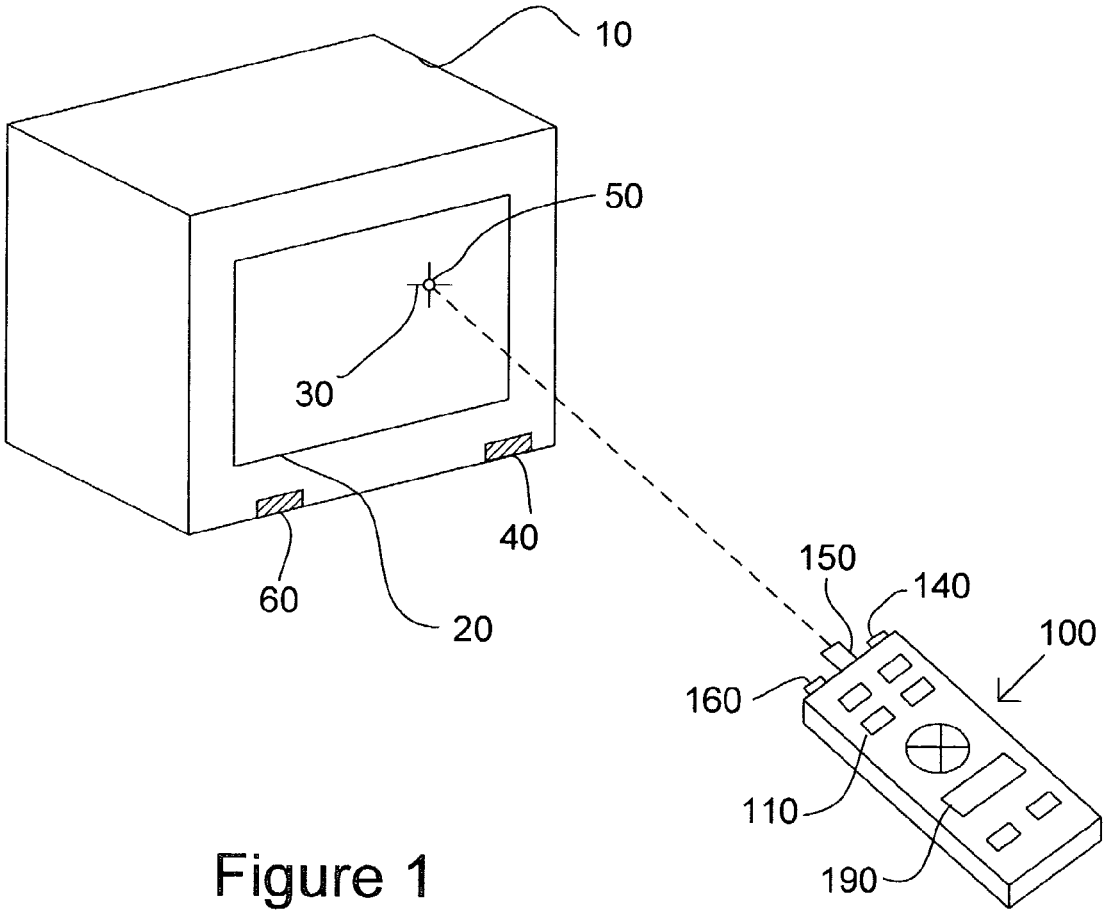
FIG. 1 shows the cursor position on the screen of a television is positioned at the aiming point of an improved remote control.

FIG. 1 illustrates an improved remote control 100 for a television 10. The improved remote control in FIG. 1 consists of a few conventional buttons 110 for performing some commonly used functions, such as volume up and down, channel up and down, et. al. The remote control in FIG. 1 also consists of a non-conventional button 190. The non-conventional button acts more or less like a "mouse" button, and what function the non-conventional button performs when pressed depend on where the cursor 30 appears on the screen 20 of the television. The actions of these conventional or non-conventional buttons are transmitted into the television by coding them with either infrared or electromagnetic waves. To make remote control 100 easier to use, a remote-pointing device 150 is added on the remote control for directly controlling the position of cursor 30 on the television. Remote-pointing device 150 defines an aiming point 50 at the position on the television screen pointed by remote-pointing device 150. When some communication with the television are implemented, remote-pointing device 150 also enables television 10 to find out aiming point 50. Television 10 then will display cursor 30 at that aiming point 50.

Figure 2:
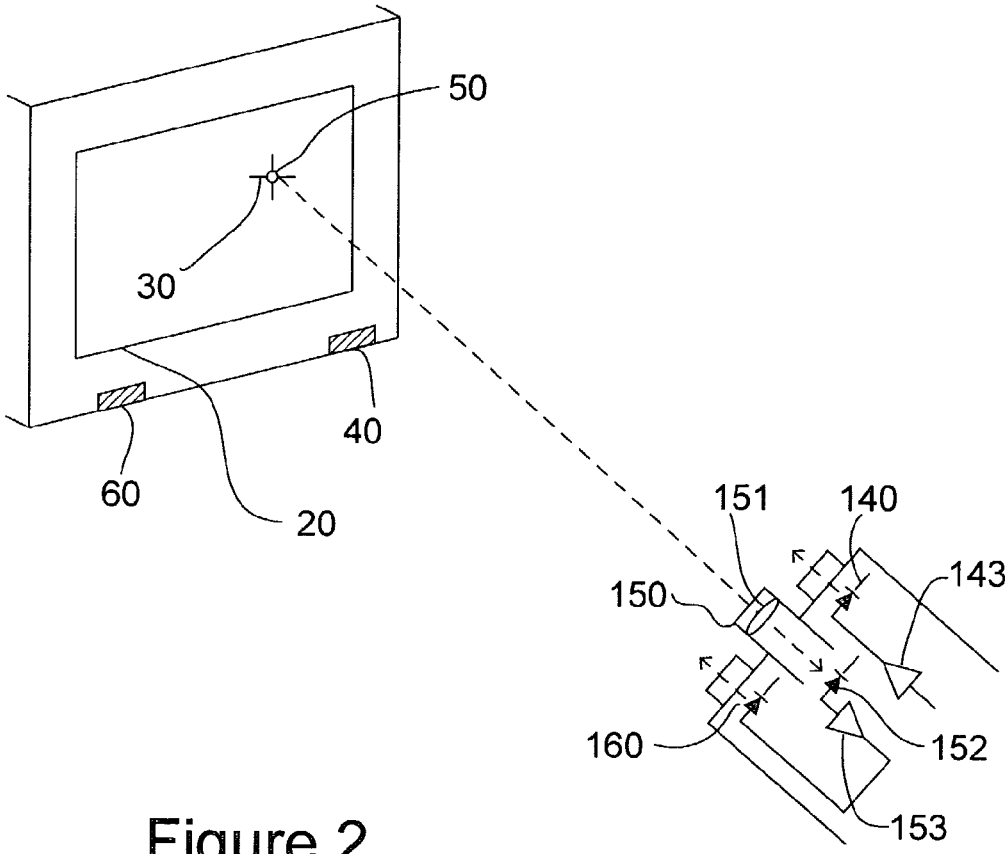
FIG. 2 shows that the light emitted from the aiming point, after passing though a lens system, is detected by a photo detector.

In FIG. 2, it is shown that a light-scope is used as remote pointing device 150. The light-scope consists of a lens system 151 that define a very narrow filed of view and a photo detector 152. Only the light from a small area near aiming point 50 are within the narrow field of view, and only the light from that small area is able to enter the light-scope 150. The light from aiming point 50, after passing through lens system 151, is detected by photo detector 152, and converted into an electric signal. The converted electric signal, after being amplified by an amplifier 153, is used to drive an LED 160 to create a communicating light signal that is sent back to the television. The communicating light signal from LED 160 is received by a photo-detecting system 60 on the television. The television will then use the communicating light signal to determine aiming point 50, and put cursor 30 at aiming point 50.

Television screen 20 is usually the screen of a CRT tube or the screen of a projection display. The imaging on television screen 20 is displayed by scanning the screen line by line with electron guns (as in the case of a CRT tube) or light guns (as in the case of a projection screen). Every full imaging is scanned in less than 1/30 second. The timing when the light from aiming point 50 is emitted can be measured by photo-detecting system 60 that receives from the remote control the communicating light signal which is, to some extent, a replica of the light signal detected by photo detector 152 in the light-scope. By comparing this measured timing with the synchronization signal for the imaging scanning, the position (or coordinates) of aiming point 50 can be determined.

In FIG. 2, the communicating light signal from LED 160 is emitted with wavelength $\lambda_2$, and is received by photo-detecting system 60. In FIG. 2, the actions of the conventional or non-conventional buttons are coded by an IR signal with wavelength $\lambda_1$, and this IR signal is emitted from LED 140. The IR signal from LED 140 is received by photo-detecting system 40. To avoid the interference between the signal emitted by LED 160 and the signal emitted by LED 140, a light filter can be placed in photo-detecting system 60 to filter out any light signal with wavelength $\lambda_1$. Therefore, only the communicating light signal representing the light signal detected by photo detector 152 will be received by photo-detecting system 60.

In fact, LED 160 can be replaced with an electromagnetic emitter, if photo-detecting system 60 is replaced with an electromagnetic-detecting system. Likewise, LED 140 can also be replaced with an electromagnetic emitter, if photo-detecting system 40 is replaced with an electromagnetic-detecting system.

For the photo detector 152, it can be a photo diode, or a photo transistor, or a photo Darlington.

Figure 3:
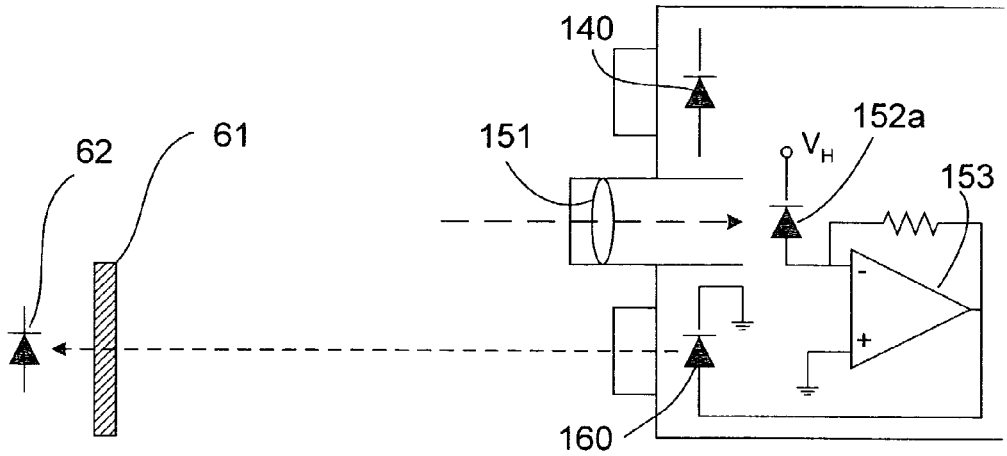
FIG. 3 shows that light signal from the aiming point, detected by a photo diode, is converted into an electric signal, and that an LED driven by the converted electric signal sends a communicating light signal back to the television.

FIG. 3 shows that the light signal from the aiming point, after passing through lens system 151, is detected with a photo diode 152*a* and converted into an electric signal. The converted electric signal is amplified by an amplifier 153, and the output of amplifier 153 is used to drive LED 160. In the photo-detecting system 60, there are a photo detector 62 and a light filter 61 for filtering out the light signal from LED 140. The communicating light signal generated by LED 160, after passing though light filter 61, is detected by photo detector 62.

Figure 4:
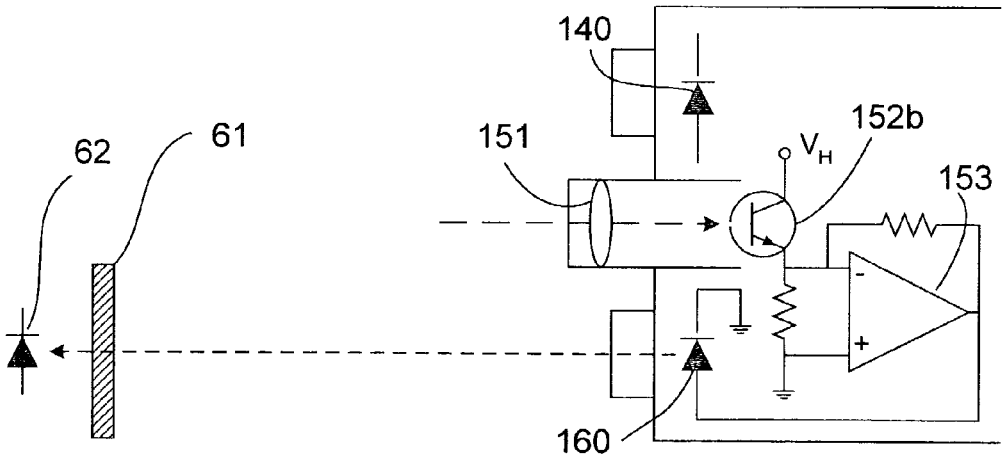
FIG. 4 shows that light signal from the aiming point, detected by a photo transistor, is converted into an electric signal, and that an LED driven by the converted electric signal sends a communicating light signal back to the television.

FIG. 4 shows that the light signal from the aiming point, after passing through lens system 151, is detected with a photo transistor 152*b* and converted into an electric signal. The converted electric signal is amplified by an amplifier 153, and the output of amplifier 153 is used to drive LED 160. In the photo-detecting system 60, there are a photo detector 62 and a light filter 61 for filtering out the light signal from LED 140. The communicating light signal generated by LED 160, after passing through light filter 61, is detected by photo detector 62.

Figure 5:
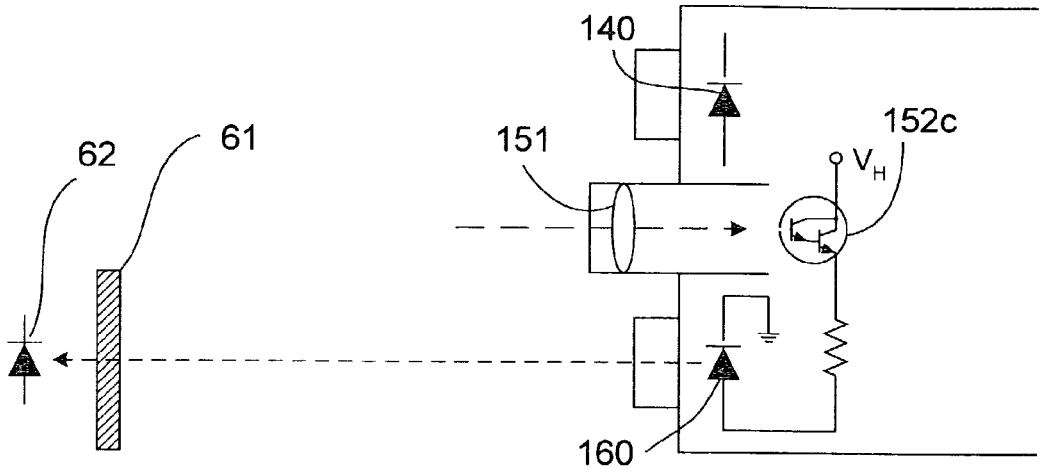
FIG. 5 shows that light signal from the aiming point, detected by a photo Darlington, is converted into an electric signal, and that an LED driven by the converted electric signal sends a communicating light signal back to the television.

FIG. 5 shows that the light signal from the aiming point, after passing through lens system 151, is detected with a photo Darlington 152*c* and converted into an electric signal. The converted electric signal is used to drive LED 160. In the photo-detecting system 60, there are a photo detector 62 and a light filter 61 for filtering out the light signal from LED 140. The communicating light signal generated by LED 160, after passing through light filter 61, is detected by photo detector 62.

The forgoing description of selected embodiments and applications has been presented for purpose of illustration. It is not intended to be exhaustive or to limit the invention to the precise form described, and obviously many modifications and variations are possible in the light of the above teaching. The embodiments and applications described above was chosen in order to explain most clearly the principles of the invention and its practical application thereby to enable others in the art to utilize most effectively the invention in various embodiments and with various modifications as are suited to the particular use contemplated. For example, with some multiplexing method, one LED can be used both for coding the actions of the control buttons and for sending back to the television the communicating light signal representing the signal entering the light-scope. Or, with some multiplexing method, the two LEDs—one for coding the actions of the control buttons and one for sending back to the television the communicating light signal related to the light signal entering the light scope—can use the same wavelength. Accordingly, the scope of the invention should be determined not by the embodiments illustrated, but by the appended claims and their legal equivalents.

I claim:

1. An improved remote control for a television having a cursor displayed on the television screen, comprising:

a remote control;

a conventional button fixed on said remote control, and the function of said conventional button being independent of where the cursor appears on the television screen;

a light-scope having a lens for defining a narrow filed of view and a photo detector for detecting the light signal passing through the lens, and said light-scope being fixed on said remote control and having the narrow filed of view defined by the lens aligned in the same direction as pointed by said remote control;

a light emitter driven by an electric signal that is converted from the light signal detected by the photo detector in said light-scope, for sending back to the television a communicating light signal representing the light signal emitted from the aiming point on the television screen pointed by said light-scope, whereby the television can display the cursor at that aiming point; and a non-conventional button fixed on said remote control, and the function of said non-conventional button being depend on where said cursor appear on the television screen.

2. An improved remote control of claim 1 wherein said light emitter is an LED.

3. An improved remote control of claim 1 wherein the photo detector in said light-scope is selected from a group consisting of photo diode, photo transistor and photo Darlington.

4. An improved remote control of claim 1 further comprising an amplifier having the input connected to the photo detector in said light-scope and having the output connected to said light emitter.

5. An improved remote control for a television having a cursor displayed on the television screen, comprising:

a remote control;

a conventional button fixed on said remote control, the conventional button being selected from a group consisting of channel up and channel down, and the function of said conventional button being independent of where the cursor appears on the television screen;

a light-scope having a lens for defining a narrow filed of view and a photo detector for detecting the light signal passing through the lens, and said light-scope being fixed on said remote control and having the narrow filed of view defined by the lens aligned in the same direction as pointed by said remote control;

a light emitter driven by an electric signal that is converted from the light signal detected by the photo detector in said light-scope, for sending back to the television a communicating light signal representing the light signal emitted from the aiming point on the television screen pointed by said light-scope, whereby the television can display the cursor at that aiming point; and a non-conventional button fixed on said remote control, and the function of said non-conventional button being depend on where said cursor appear on the television screen.

6. An improved remote control of claim 5 wherein said light emitter is an LED.

7. An improved remote control of claim 5 wherein the photo detector in said light-scope is selected from a group consisting of photo diode, photo transistor and photo Darlington.

8. An improved remote control of claim 5 further comprising an amplifier having the input connected to the photo detector in said light-scope and having the output connected to said light emitter.

9. An improved remote control for a television having a cursor displayed on the television screen, comprising:

a remote control;

a conventional button fixed on said remote control, the conventional button being selected from a group consisting of volume up and volume down, and the function of said conventional button being independent of where the cursor appears on the television screen;

a light-scope having a lens for defining a narrow filed of view and a photo detector for detecting the light signal passing through the lens, and said light-scope being fixed on said remote control and having the narrow filed of view defined by the lens aligned in the same direction as pointed by said remote control;

a light emitter driven by an electric signal that is converted from the light signal detected by the photo detector in said light-scope, for sending back to the television a communicating light signal representing the light signal emitted from the aiming point on the television screen pointed by said light-scope, whereby the television can display the cursor at that aiming point; and a non-conventional button fixed on said remote control, and the function of said non-conventional button being depend on where said cursor appear on the television screen.

10. An improved remote control of claim 9 wherein said light emitter is an LED.

11. An improved remote control of claim 9 wherein the photo detector in said light-scope is selected from a group consisting of photo diode, photo transistor and photo Darlington.

12. An improved remote control of claim 9 further comprising an amplifier having the input connected to the photo detector in said light-scope and having the output connected to said light emitter.

13. An improved remote control for a television having a cursor displayed on the television screen, comprising:

a remote control;

a conventional button fixed on said remote control, the conventional button being selected from a group consisting of channel up, channel down, volume up, volume down, and mute, and the function of said conventional button being independent of where the cursor appears on the television screen;

a light-scope having a lens for defining a narrow filed of view and a photo detector for detecting the light signal passing through the lens, and said light-scope being fixed on said remote control and having the narrow filed of view defined by the lens aligned in the same direction as pointed by said remote control;

a light emitter driven by an electric signal that is converted from the light signal detected by the photo detector in said light-scope, for sending back to the television a communicating light signal representing the light signal emitted from the aiming point on the television screen pointed by said light-scope, whereby the television can display the cursor at that aiming point; and a non-conventional button fixed on said remote control, and the function of said non-conventional button being depend on where said cursor appear on the television screen.

14. An improved remote control of claim 1 wherein said light emitter is an LED.

15. An improved remote control of claim 1 wherein the photo detector in said light-scope is selected from a group consisting of photo diode, photo transistor and photo Darlington.

16. An improved remote control of claim 1 further comprising an amplifier having the input connected to the photo detector in said light-scope and having the output connected to said light emitter.

* * * * *